US010835008B2

(12) United States Patent
Massey

(10) Patent No.: US 10,835,008 B2
(45) Date of Patent: Nov. 17, 2020

(54) SALON HAIR DRYING SYSTEM AND METHOD

(71) Applicant: Lorraine Massey, Leonia, NJ (US)

(72) Inventor: Lorraine Massey, Leonia, NJ (US)

( * ) Notice: Subject to any disclaimer, the term of this patent is extended or adjusted under 35 U.S.C. 154(b) by 44 days.

(21) Appl. No.: 16/357,649

(22) Filed: Mar. 19, 2019

(65) Prior Publication Data

US 2020/0297093 A1 Sep. 24, 2020

(51) Int. Cl.
*A45D 20/18* (2006.01)
*A45D 20/16* (2006.01)

(52) U.S. Cl.
CPC ..... *A45D 20/16* (2013.01); *H05B 2203/022* (2013.01)

(58) Field of Classification Search
CPC ..... A45D 20/16; A45D 20/04; A45D 20/06; A45D 20/08; A45D 20/122; A45D 20/20; A45D 20/22; A45D 20/28; A45D 20/26; A45D 20/44; A45D 20/18; H05B 2203/022
USPC ..... 34/98, 96, 283, 97, 99; 219/222
See application file for complete search history.

(56) References Cited

U.S. PATENT DOCUMENTS

| | | | | |
|---|---|---|---|---|
| 2,139,250 | A * | 12/1938 | Zingone | A45D 20/44 126/116 R |
| 2,314,101 | A * | 3/1943 | Phipps | A45D 20/44 34/77 |
| 8,230,615 | B1 * | 7/2012 | Fletcher | A45D 20/00 34/283 |
| 9,854,893 | B2 * | 1/2018 | Robinson | A45D 20/12 |
| 2016/0316884 | A1 * | 11/2016 | Ben-Hur | A45D 20/16 |
| 2018/0249804 | A1 * | 9/2018 | Walker | A42B 1/041 |

FOREIGN PATENT DOCUMENTS

| | | | | |
|---|---|---|---|---|
| EP | 1834540 | A1 * | 9/2007 | A45D 44/02 |

* cited by examiner

*Primary Examiner* — John P McCormack
(74) *Attorney, Agent, or Firm* — Uradnik Law Firm PC

(57) ABSTRACT

A hair drying system for a salon includes one or more individual hair drying stations located remotely from a centrally-located source of heated air; and ductwork connecting the source of heated air with each individual hair drying station.

18 Claims, 3 Drawing Sheets

SALON HAIR DRYING SYSTEM AND METHOD

FIELD OF THE DISCLOSURE

The invention relates generally to a system and method for drying hair in a hair salon setting, and more particularly to a centralized system for generating heated air to feed one or more hair drying stations.

BACKGROUND

A number of methods are used today to dry clients' hair in a hair salon setting. Individual hand-held hair dryers are cumbersome at best. Their use creates friction and frizz if hurried, and they do not allow the stylist to attend to other clients while the hair of one client is being dried.

Another method is using individual hard hat dryers with a design element that has not been updated since the 1940's when women had roller sets. These dryers are very heavy and many are often installed with an arm pivot from the wall at multiple drying stations. Hard hat dryers are expensive and need to be professionally installed. They also are cumbersome to operate. They are noisy during operation for both the client and the salon. Also, because they are dark in color, hard hat dryers leave the client feeling claustrophobic and often neglected. Many clients have complained that they are left and forgotten for too long when they are under the dryers. Many clients complain of over-heated scalp irritations too.

Todays clients prefer longer hair and are more natural and curly hair conscious. Because of an older design, hard hat dryers reach only to the shoulders; the hair below the shoulders remains wet because the heat flow does not reach that area. Often the motors of hard hat dryers break down. Requiring an engineer to fix and replace the motors is time inefficient and costly, making it less expensive to simply buy another dryer. This situation alone also may become very frustrating and embarrassing because clients are left waiting for a dryer to become available.

Thus, there remains a need for an updated, improved and gentle system and method for drying the entire head of hair evenly in its natural state with no frizz or outside friction. There is a need to keep the hair and scalp healthy, and to create a more pleasant salon drying experience both aesthetically & functionally.

SUMMARY

The present disclosure provides a system and method for drying hair in a hair salon setting at multiple hair drying stations. Air is heated centrally and delivered via ductwork to one or more hair drying stations. An organza veil may be used at a drying station to help direct the heated air as desired. The veil also creates a pleasant and small microclimate about the hair. Air flow dries the entire head of hair evenly and quickly, and the client is allowed to see the environment around her. The system has almost no noise, and once the client is inside the warmth of the drying veil the client relaxes almost immediately. Accordingly, the invention relates generally to a system and method for controlled heat flow to dry the entire head of hair naturally, evenly and gently in a hair salon setting, and more particularly to a centralized system for generating heated air to feed one or more hair drying stations at which small, contained microclimates are created allowing the hair to dry fully in its natural state without frizz or friction.

Other benefits and advantages of the present disclosure will be appreciated from the following detailed description.

DESCRIPTION OF THE DRAWINGS

Exemplary embodiments of an exemplary system and method for drying hair in a salon setting are shown in the accompanying drawings.

DETAILED DESCRIPTION

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to the drying of hair; etc. Such aspects related to this disclosure do not depart from the invention, and it is therefore intended that the invention not be limited by the certain aspects set forth of the events and circumstances related to this disclosure.

Figure 1:
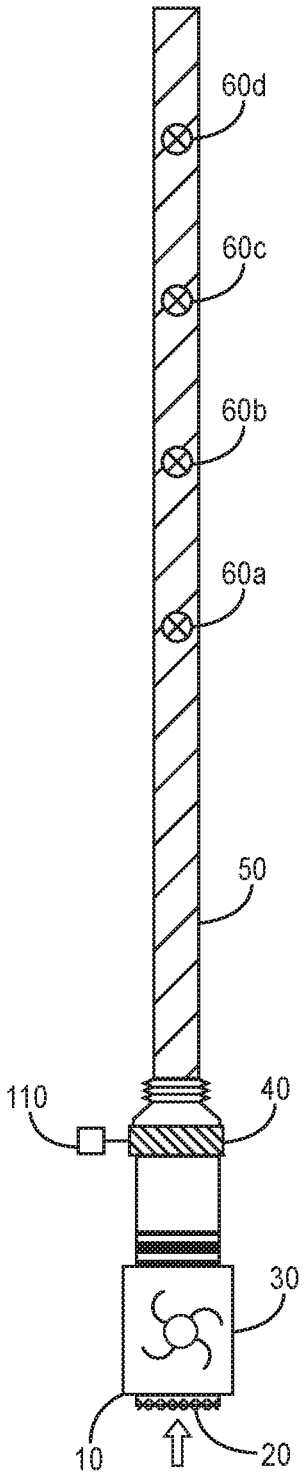
FIG. 1 is a top view schematic of a portion of an exemplary hair drying system for a salon setting.

Turning now to the drawings, a portion of an exemplary system and method for drying hair in a hair salon setting is shown in FIG. 1. Air is heated centrally and then distributed to one or more individual drying stations. Air enters the system at inlet 10. The air may pass through a filter or screen 20 prior to entry into blower 30. Blower 30 typically include a fan that draws in air from inlet 10 and pushes the air through the remaining portions of the hair drying system. Air exiting blower 30 is heated by passing the air through a heating assembly. In one embodiment a hot water heating coil 40 may be used. In another embodiment an electric resistance heater may be used. A gas burner heating assembly also may be used in another embodiment. Heated air then passes into main duct 50 to supply the individual hair drying stations via station feeder ducts 60*a*, 60*b*, 60*c*, 60*d*, etc.

Figure 2:
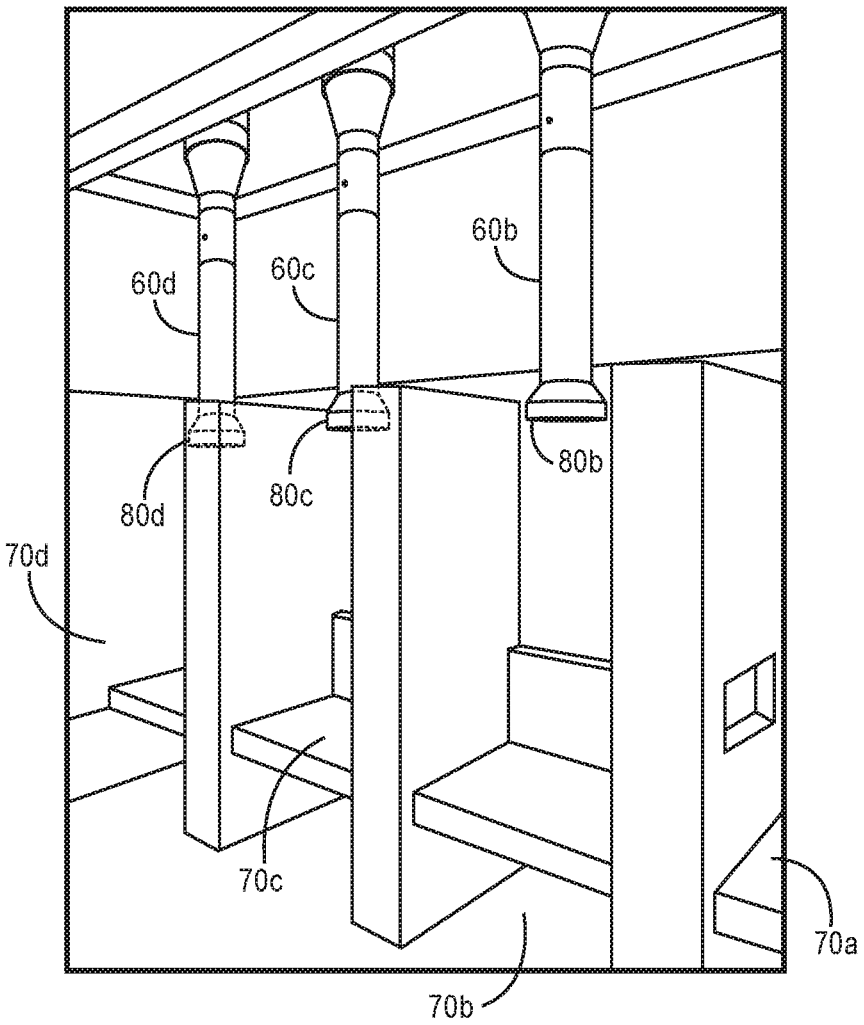
FIG. 2 is a perspective view of multiple exemplary hair drying stations that may be used in connection with the hair drying system portion shown in FIG. 1.

As shown in the drawings, main duct 50 is generally straight and positioned above the individual hair drying stations. The station feeder ducts 60*a*, 60*b*, 60*c*, 60*d* extend downwardly from main duct 50 to separate individual hair drying stations 70*a*, 70*b*, 70*c*, 70*d*. See FIG. 2. The lower end of each station feeder duct may include a diffuser 80*a*, 80*b*, 80*c*, 80*d* to help direct the air from the station feeder duct to the client in a desired manner. Of course the exact configuration of the ductwork supplying heated air from a source to individual hair drying stations may vary depending upon the circumstances involved in a particular application.

Figure 3:
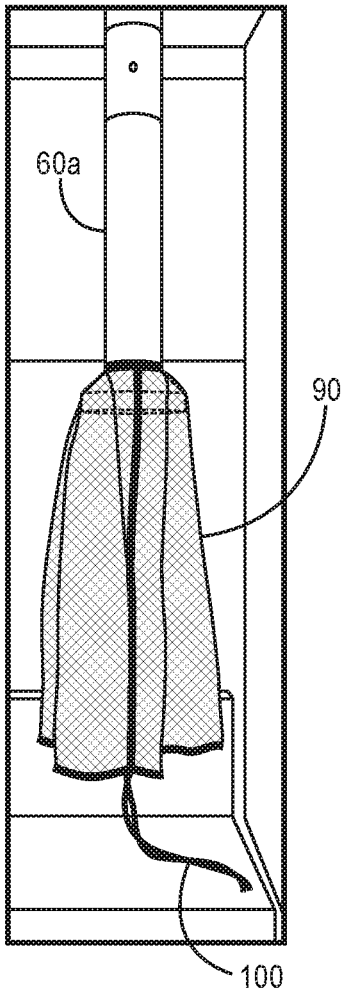
FIG. 3 is a perspective view of an exemplary veil system in place at one of the hair drying stations shown in FIG. 2.

In some embodiments an organza veil 90 may be used alone or in conjunction with the diffuser to help direct the heated air to the client seated beneath the station feeder duct outlet. See FIG. 3. The veil 90 may be wrapped loosely about an individual's head and shoulders, and may be held closed by a drawstring 100. The veil also may be extended lower about an individual, particularly in cases involving long hair. The veil creates a small, contained micro-climate that allows the hair to dry fully in its natural state without frizz or friction.

Each station feeder duct 60*a*, 60*b*, 60*c*, 60*d* may be equipped with a damper that may be opened or closed depending upon whether the particular hair drying station is in use. Closing the damper may generally eliminate the flow of heated air to the hair drying station when no client is present.

The temperature and pressure of the heated air and the flow of air may be monitored by one or more sensors located within the system. As shown in the drawings, temperature sensor 110 may be positioned proximate water heating coil 40. Temperature sensors at each individual drying station also may be used. A central control system may receive inputs from the one or more temperature sensors and regulate the flow of hot water through the water heating coil 40. Various parameters such as water flow rate, air flow rate, water temperature, etc. may be adjusted by the central control system. If an electric resistance heating assembly is used, additional parameters such as current and voltage may be controlled. In a gas burner system, additional parameters such as gas flow rate may be controlled.

The blower 30 in one embodiment may be a variable speed blower. The speed of the blower 30 may be adjusted upward or downward depending upon sensor inputs received by the central control system. A sensed drop in pressure (static or dynamic) within the ductwork, by way of example, may trigger the blower 30 to increase speed. Sensing the opening of a damper may cause the blower 30 to start or to increase speed. Sensing the closing of all dampers may cause the blower 30 to shut down. Thus, a system may be provided that controls blower speed based upon one or more pressures sensed within the ductwork, based upon the open/close state of a damper, etc.

One embodiment of a method in accordance with the present disclosure may include the steps of (i) heating air centrally to form heated air, and (ii) providing a portion of the heated air to one or more individual hair drying stations. In another embodiment, a method in accordance with the present disclosure may include the steps of: (a) sensing at a hair drying station the opening of a station feeder duct damper; (b) in response to the sensing of the opening of a station feeder duct damper, flowing air through a heating assembly centrally located from the hair drying station to form heated air; and (c) providing the heated air to the hair drying station. In another method embodiment, the included steps may include: (a) opening a station feeder duct damper; (b) flowing air through a heating assembly centrally located from a hair drying station to form heated air; (c) providing the heated air via ductwork to a hair drying location; and (d) providing a veil at the hair drying location to direct the heated air about the hair being dried. In a further embodiment, a diffuser may be provided to help direct the heated air at the drying location.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. A hair drying system comprising one or more individual hair drying stations located remotely from a centrally-located source of heated air; ductwork connecting the source of heated air with each individual hair drying station; and a veil directing the flow of heated air exiting the ductwork.

2. The hair drying system of claim 1, wherein the source of heated air includes a blower.

3. The hair drying system of claim 1, wherein the source of heated air includes a hot water heating coil.

4. The hair drying system of claim 1, wherein the source of heated air includes a sensor that senses the temperature of the heated air.

5. The hair drying system of claim 1, wherein the ductwork includes a main duct that supplies heated air to one or more hair drying station feeder ducts.

6. The hair drying system of claim 5, wherein a hair drying station feeder duct includes a damper for controlling the flow of heated air to the individual hair drying station.

7. The hair drying system of claim 5, wherein a hair drying station feeder duct includes a diffuser.

8. The hair drying system of claim 5, wherein the veil directs the flow of heated air exiting a hair drying station feeder duct.

9. A hair drying method including the steps of: (a) sensing at a hair drying station an opening of a station feeder duct damper; (b) in response to the sensing of the opening of a station feeder duct damper, flowing air through a heating assembly centrally located from the hair drying station to form heated air; (c) providing the heated air to the hair drying station; and (d) directing the heated air with a veil.

10. The method of claim 9 wherein the heating assembly includes a hot water coil.

11. The method of claim 9 wherein the heating assembly includes an electric resistance heater.

12. The method of claim 9 wherein the heating assembly includes a gas burner.

13. The method of claim 9 wherein the heated air is provided to the hair drying station via a diffuser.

14. A hair drying station for an individual, with an at least in part wet head of hair, including a veil to direct heated air about the individual's head and shoulders.

15. The hair drying station of claim 14, wherein the veil defines a micro-climate about the head of the individual.

16. The hair drying station of claim 14 including a source of heated air located remotely from the hair drying station.

17. The hair drying station of claim 16 including ductwork connecting the source of heated air and the veil.

18. The hair drying station of claim 17 including a diffuser that directs heated air from the ductwork to the veil.

* * * * *